US005963151A

United States Patent [19]

Hubbard

[11] Patent Number: 5,963,151

[45] Date of Patent: Oct. 5, 1999

[54] BUS STOP CALL SYSTEM

[76] Inventor: Rayford C. Hubbard, 8808 Darby Ave., #214, Northridge, Calif. 91326

[21] Appl. No.: 08/383,608

[22] Filed: Feb. 2, 1995

Related U.S. Application Data

[63] Continuation of application No. 08/136,805, Oct. 14, 1993, abandoned.

[51] Int. Cl.[6] ..... G08G 1/123

[52] U.S. Cl. ..... 340/996; 200/DIG. 2; 340/994

[58] Field of Search ..... 340/994, 996, 340/988, 905, 433, 904, 573; 200/DIG. 2, 52 R

[56] References Cited

U.S. PATENT DOCUMENTS

| | | | |
|---|---|---|---|
| 1,211,976 | 1/1917 | Spencer et al. | 200/DIG. 2 |
| 1,402,609 | 1/1922 | Hodous . | |
| 1,906,193 | 4/1933 | Vitale | 200/335 |
| 2,106,658 | 1/1938 | Rakos | 200/DIG. 2 |
| 2,152,045 | 3/1939 | Gulland | 200/97 |
| 3,596,010 | 7/1971 | Patterson | 340/996 |
| 3,700,835 | 10/1972 | Rackson | 200/52 R |
| 3,700,836 | 10/1972 | Rackson | 200/52 R |
| 4,159,490 | 6/1979 | Wood | 340/996 |
| 4,177,460 | 12/1979 | Hoinski | 340/576 |
| 4,361,834 | 11/1982 | King | 340/575 |
| 4,814,632 | 3/1989 | Glaeser et al. | 307/116 |
| 5,218,629 | 6/1993 | Dumond, Jr. et al. | 340/904 |

FOREIGN PATENT DOCUMENTS

| | | | |
|---|---|---|---|
| 2406266 | 5/1979 | France | 340/994 |
| 0067700 | 3/1990 | Japan | 340/996 |

*Primary Examiner*—Brent A. Swarthout
*Attorney, Agent, or Firm*—Harvey S. Hertz

[57] ABSTRACT

A passenger notification system to warn (bus) passengers of the next scheduled stop. A sensory indication which may be a verbal announcement or a lighted display (or both) within the bus is activated by the driver as each stop, transfer point or point of interest, approaches. A switch responsive to relative motion between the driver's upper arm and torso provides activation of a pre-recorded message in audio form from a sound transcriber. The lighted display is coded and activated from recorded signals. The sequence may easily be modified to fit each bus route.

5 Claims, 1 Drawing Sheet

BUS STOP CALL SYSTEM

This is a continuation of application Ser. No. 08/136,805, filed on Oct. 14, 1993, now abandoned.

BACKGROUND OF THE INVENTION

1. Field of the Invention

The driver of a passenger conveyance vehicle, such as a metropolitan bus, is faced with multiple demands on his attention. Steering and other bus controls occupy the driver's hands most of the time, and his (or her) feet are usually devoted to braking or other functions. Accordingly, there is little opportunity for safely adding to the driver's duties. This is particularly true in traffic situations where frequent lane changing is required and curb stops are frequent.

The "Americans With Disabilities Act" mandates that a bus operator routinely announce major intersections, transfer points and places of interest as they are approached. This requirement pertains whether or not a disabled person is on board.

With this requirement extant, there is need for an announcement system (sound or visual or both) which can be pre-programmed to make appropriate announcements along a corresponding route. Such a system must be easily reprogrammed for different routes for which the bus may be assigned.

The preferred apparatus according to the invention is operated independently of the driver's hands or feet as will be understood as the description proceeds.

2. Description of the Prior Art

In the prior art, various systems are known for effecting an action or signal as a result of a driver's body motions. For example, various arrangements of the "dead man" type are known in the art. Such devices detect drowsiness of a machine operator or long distance vehicle driver as evidenced by head nodding, limb relaxation, etc. Usually, an electrical circuit is broken when head nodding or relaxation of a hand grip occurs and an appropriate alarm is activated. U.S. Pat. No. 4,177,460 and 4,361,834 describe such systems. U.S. Pat. Nos. 1,906,193; 2,152,045 and 3,700,835 describe various devices for voluntary or involuntary body movement to activate an action or function.

No prior art is known to the inventor which would anticipate the unique combination of structure and function presented herein.

SUMMARY OF THE INVENTION

The combination of the invention includes a recorder into which a series of messages is recorded; these messages identifying a corresponding series of bus stops, transfer points and possibly other points of interest along a given route. A switch is mounted to be activated by pressure between the bus driver's upper arm and his torso, leaving hands and feet free for steering, braking, turn signal operation, etc.

Each operation of the aforementioned switch enables the recorder to play back one recorded message. The message is provided to at least one electric-to-sound transducer to inform passengers of approaching curb stops, etc.

The aforementioned recorder may be a two-track device for separately, but contemporaneously, providing a second signal train which is a coded signal for activating a visual message display of the same basic message in a lighted display.

The details of the invention will be described hereinafter.

DESCRIPTION OF THE PREFERRED EMBODIMENT

Figure 1:
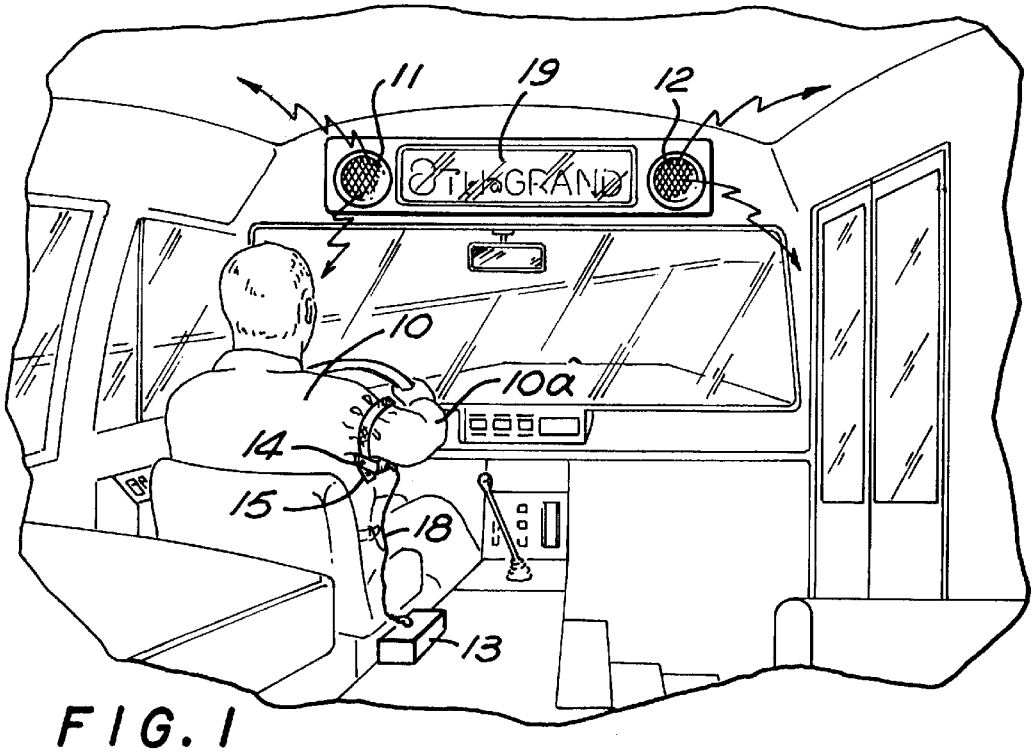
FIG. 1 is a pictorial showing the interior of a bus cab with the driver appropriately seated.

Referring now to FIG. 1, a bus driver 10 is shown seated typically. Two loudspeakers 11 and 12 (generically referred to as electric-to-sound transducers) are illustrated directly above the driver's head. The block 13 represents a recorded message player, preferably a magnetic type cassette player, since replacement of the cassette with one corresponding to a different route is quickly and easily accomplished. Alternatively, a compact disc or other forms of recorded technology could be used. A switch 14, when closed, activates the player 13 for a time sufficient to complete the next message through speakers 11 and 12 and a visual message display 19. The driver 12 hears the message and only activates switch 14 for a corresponding time.

Operation of the switch 14 is accomplished when driver 10 rotates his arm 10*a* downward to depress a trigger panel 15 without interrupting the function of his hand. The switch 14 is shown with the trigger panel 15 to make its function clear. The panel 15 is depressed against the driver's torso. Straps 16 and 17, preferably of the "Velcro" type, provide easy and quick attachment of the switch 14 to the driver's arm. Alternatively, plastic snap fasteners could be used as well.

Figure 2:
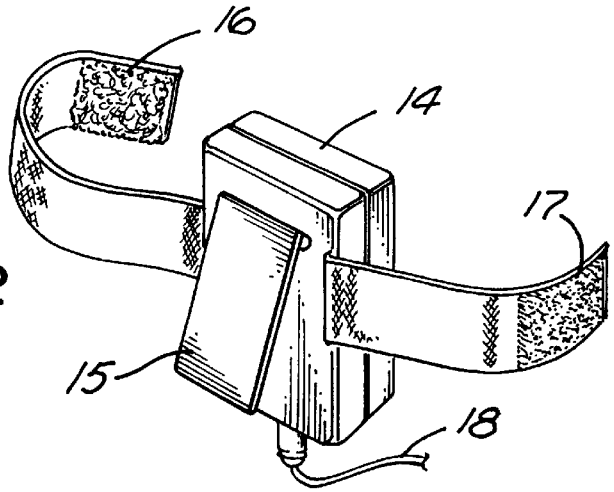
FIG. 2 is a detail of a typical switch configuration.

The switch 14, the tape player 13, and the loudspeakers 11 and 12 are items of commerce and are readily obtained. The switch 14 may not have a hinged trigger panel 15, but may have a depressible button. The switch 14 is of the momentary type, the trigger panel 15 being normally spring biased outward (as shown in FIG. 2). The spring or springs biasing panel 15 (or for that matter, the operating button in an alternative switch structure), should be only strong enough to ensure against unintended operation as the driver's arm is moved. On the other hand, this spring action should not be strong enough to irritate the driver's torso in repeated operation.

Figure 3:
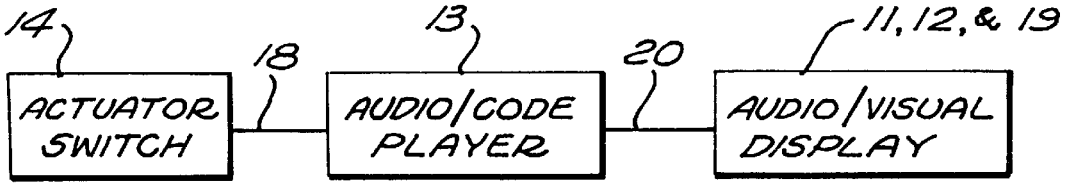
FIG. 3 is a circuit block diagram depicting the interconnected elements of the combination.

FIG. 3 depicts the electrical interconnections in block form. A lead 18 conveys the switch signal to the player 13 and lead 20 conveys the player output messages to the audio/visual display formed of loudspeakers 11 and 12 and display 19 of FIG. 1. The lead 20 is not shown in FIG. 1, but it is to be understood that it is present in the FIG. 1 arrangement. Further, power supply leads are not shown because these are entirely conventional and well understood in the electronic arts.

If both the audio output and visual display are to be used, the player 13 preferably has two tracks, one each for independently energizing the speakers 11 and 12 and visual display 19 contemporaneously. The visual display 19 may be of relatively simple dot-matrix type. Such a display requires a discrete code to control each visual message. Such a code may be stored on the second track in player 13, or if only a visual presentation is contemplated, the aforementioned codes can be stored on a single track in player 13.

The message player 13 if activated by a switch other than switch 14, still represents a novel combination although the switch as shown on FIG. 1 is preferred.

The terms "system for sensory announcement" are intended to be generic to both the audio and visual message presentation.

It will be evident to the person of skill in the related arts that various modifications of the structure shown are possible. For one such modification, the switch 14 may be strapped or otherwise affixed to the driver's torso rather than his arm, operation of the switch resulting as the driver's arm is lowered to an extent sufficient to depress the trigger panel 15.

In addition, it should be noted that the tape or cassette player could play background music with the message announcements interspersed in the music. Other variations within the spirit of the invention are possible and, accordingly, it is not intended that the scope of the invention should be limited to the embodiment shown with drawings or described herein. The drawings and specifications are intended to be typical and illustrative only.

The control device actuator combination described has utility in various other systems wherever switch actuation is desired without foot, hand, or finger involvement.

I claim:

1. In a passenger conveyance vehicle, a system for sensory announcement of a series of discrete messages, each of which corresponds to an approaching stop or point of interest, the combinantion comprising:

first means presenting said discrete messages in separate visual and audible form comprising at least one visual display and at least one electric-to-sound transducer;

second means providing separate first and second pre-recorded electrical signals corresponding to said visual and audible displays, respectively, said second means applying said pre-recorded electrical signals to control said first means to present said discrete messages, said second means including a dual-track play-back device to produce contemporaneous electrical signals applied to said first means to present visual display and audible messages each representative of the same stop or point of interest announcement;

and third means for activating said second means including a mechanical pressure operated switch mounted adjacent an arm of the vehicle operator, said mounting being such that said switch operates to activate said second means in response to pressure applied between said operator's arm and torso as a voluntary act of said operator.

2. Apparatus according to claim 1 in which said playback device is a magnetic tape player.

3. Apparatus according to claim 2 in which said first means comprises at least one loudspeaker as said electric-to-sound transducer and at least one signal train for controlling said visual display.

4. Apparatus according to claim 1 in which said visual display is a dot-matrix lighted panel.

5. In a passenger conveyance vehicle, a system for sensory announcement of a series of discrete messages, each identifying an approaching stop or point of interest, the combination comprising:

first means including a play-back device for transcribing signals recorded therein;

second means including at least one sensory indicator within said vehicle, said second means being responsive to corresponding transcribed signals from said first means, said sensory indicator further comprising both a lighted display and at least one electrical-to-sound transducer, said lighted display being responsive to coded signals appropriate for controlling said lighted display from said first means, said transducer being responsive to separate audio message representing signals from said first means thereby to produce a contemporaneous lighted display and audio message both representative of the same corresponding stop or point of interest announcement;

third means for controlling said first means including a pressure operated switch mounted adjacent an arm of said vehicle driver, said mounting being such that said switch operates to activate said first means in response to pressure between said driver's arm and the torso of said driver, application of said pressure being a voluntary act of said driver; and said first means further comprising a dual-track recorder and playback device to record and play back said coded signals and said audio message representing signals.

* * * * *